United States Patent [19]

Ehrlich et al.

[11] Patent Number: 4,766,575

[45] Date of Patent: Aug. 23, 1988

[54] CYLINDRICAL SONAR ARRAY

[75] Inventors: Stanley L. Ehrlich, Middletown, R.I.; George G. Gray, Mattapoisett, Mass.

[73] Assignee: Raytheon Company, Lexington, Mass.

[21] Appl. No.: 80,152

[22] Filed: Jul. 29, 1987

Related U.S. Application Data

[63] Continuation of Ser. No. 826,392, Feb. 5, 1986.

[51] Int. Cl.[4] ..... H04R 17/00

[52] U.S. Cl. ..... 367/153; 367/155; 367/165; 367/173

[58] Field of Search ..... 367/153, 155, 173, 87, 367/88, 140, 141, 165, 129, 130

[56] References Cited

U.S. PATENT DOCUMENTS 4,001,763 1/1977 Kits van Heyningen ..... 367/12

4,601,024 7/1986 Broding ..... 367/88

*Primary Examiner*—Deborah L. Kyle

*Assistant Examiner*—John W. Eldred

*Attorney, Agent, or Firm*—Martin M. Santa; Richard M. Sharkansky

[57] ABSTRACT

A cylindrical array employs rectangular planar array segments which extend in the axial direction when assembled on a cylindrical conducting plate having flat longitudinal portions to which the planar array segments are attached. Each planar array segment comprises two columns of planar transducer elements with each column extending in the axial direction of the cylinder. The acoustic center of each transducer lies on the circumference of a right circular cylinder. The acoustical requirements of a cylindrical array are satisfied to allow multiple beams to be formed with a minimum of complexity and with the same versatility as in the curved array segment cylindrical array embodiment.

11 Claims, 4 Drawing Sheets

CYLINDRICAL SONAR ARRAY

This application is a continuation of application Ser. No. 826,392, filed Feb. 5, 1986.

BACKGROUND OF THE INVENTION

This invention relates to a large aperture cylindrical array of sonar transducers wherein the transducers comprise polymer hydrophones. One prior-art technique for construction of such arrays, shown in FIG. 1, is to employ the cylindrically curved array segments 20 of FIG. 2, each segment typically containing two rows each having fourteen polymer hydrophones 21. Each polymer hydrophone 21 is typically five inches square with a half-inch spacing between adjacent hydrophones of a segment. Sixteen circular-arc segments are arranged in side-by-side configuration to form the cylindrical array 10 of FIG. 1 with the spacing between adjacent hydrophones of adjacent segments also being spaced by one-half inch. The illustrative distance of one-half inch is thought to be the minimum practical design geometry. Edge-to-edge distance between hydrophones of adjacent segments should be the same as edge-to-edge distance between the hydrophones of the same segment in order to maintain symmetry. The preceding arrangement results in a cylindrical array whose length in the direction of the axis of the cylinder is substantially twice that of the arc of the array. The acoustic properties of the array depends upon minimum symmetrical spacing of the hydrophones in both their circumferential and longitudinal spacing. The array segments are constructed with two rows of hydrophones so that the space between the adjacent corners of four adjacent hydrophones in an array segment may be utilized for fasteners and electrical connectors without disturbing this symmetry. Acoustical array segments 20 when assembled into an array 10 must have a smooth faired outer surface between segments and at the edges of the array to minimize water flow noise which degrades acoustic performance.

Prior-art designs of array segments 20 are characterized by each segment being formed with a cylindrical curve in its long dimension. The array segments are assembled in side-by-side relationship on a cylindrical signal conditioning plate to form an array 10. Signal conducting wires are connected to each transducer element and are assembled into a cable (not shown) which exits the back of each segment. This prior-art design has the following disadvantages. The gap between each array segment must be filled void-free and precisely faired to minimize flow noise. This is a difficult and expensive task. The gap filler is usually of a material which is less than perfectly homogeneous with the outer rubber/air decoupler of each array segment which results in acoustical degradation due to scattering. Also, curved array segments are difficult to manufacture and their assembly is difficult and expensive. For example, the tooling for a curved surface is expensive. Also, the array segment 20 assembly requires the fasteners and locating pins on the cylindrical signal conditioning plate (to which the segments 20 are attached) to be parallel to each other (and thus not radial) requiring expensive spot facing of components. Also, manufacturing and assembly operations which require indexing are difficult. Also, operations such as pouring encapsulants to fill counterbores and the gap between array segments are more difficult and time consuming on a curved assembly of segments.

Hitherto, the curved array segment 20 design has been thought to be necessary to maintain symmetry of the hydrophones in that with the curved design, each hydrophone 21 is normal to the radius 22 of the cylindrical array and equidistant from the center line 23. These latter features were considered necessary to allow versatility in combining appropriately delayed outputs of each of the transducer elements 21 in order to generate a multiplicity of beams from one cylindrical array 10.

SUMMARY OF THE INVENTION

The aforementioned problems are overcome and other objects and advantages of a different form of construction of a cylindrical array are provided by an array, in accordance with the invention, which employs rectangular planar array segments which extend in the axial direction when assembled to form a cylindrical array on a cylindrical conditioning plate having flat longitudinal portions to which the planar array segments are attached. Each planar array segment comprises two columns of planar transducer elements with each column extending in the axial direction of the cylinder. The acoustic center of each transducer lies on the circumference of a right circular cylinder. All of the disadvantages of the curved array segment design discussed in the Background of the Invention are either eliminated or reduced while satisfying the acoustical requirements of a cylindrical array which allows multiple beams to be formed with a minimum of complexity and with the same versatility as in the priorart curved array segment cylindrical array embodiment.

BRIEF DESCRIPTION OF THE DRAWINGS

The aforementioned aspects and other features of the invention will be apparent from the following description taken in conjunction with the accompanying drawings wherein.

DESCRIPTION OF THE PREFERRED EMBODIMENT

Figure 1:
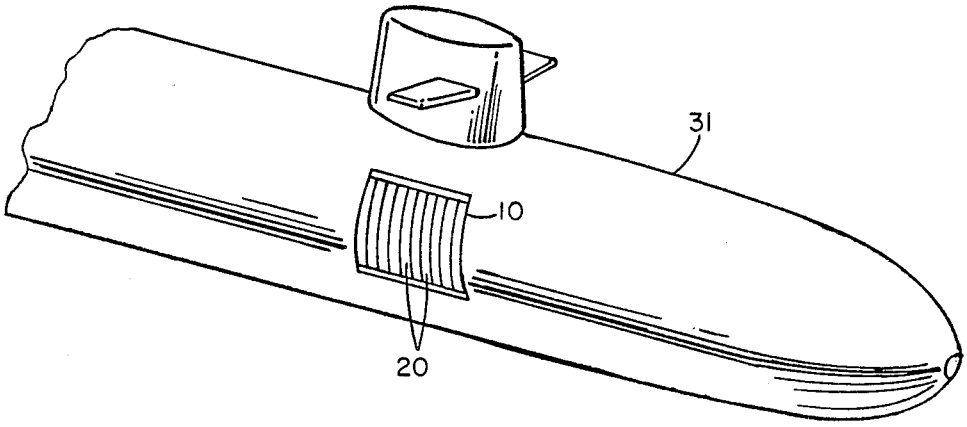
FIG. 1 PRIOR ART
FIG. 1 is a pictorial view of a sonar array of the prior art attached to a cylindrical-shaped vessel.
Figure 2:
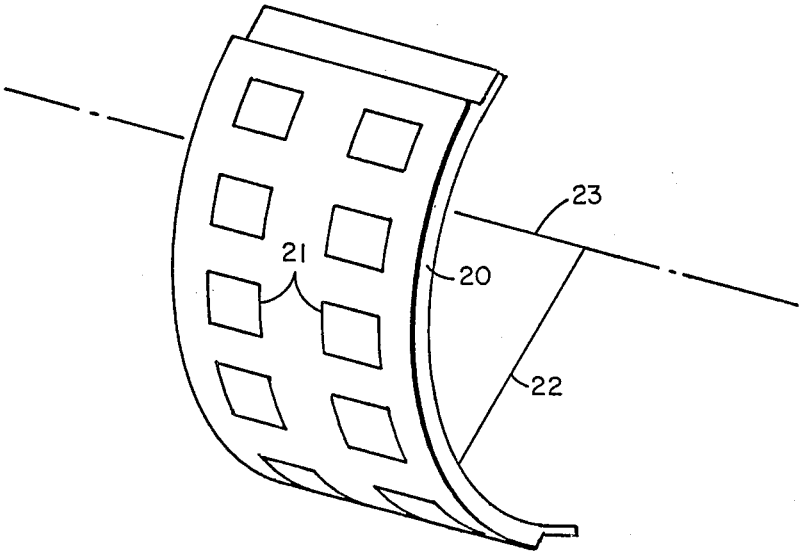
FIG. 2 PRIOR ART
FIG. 2 is a detailed view of one of the segments of the prior art from which the sonar array of FIG. 1 is assembled.
Figure 3:
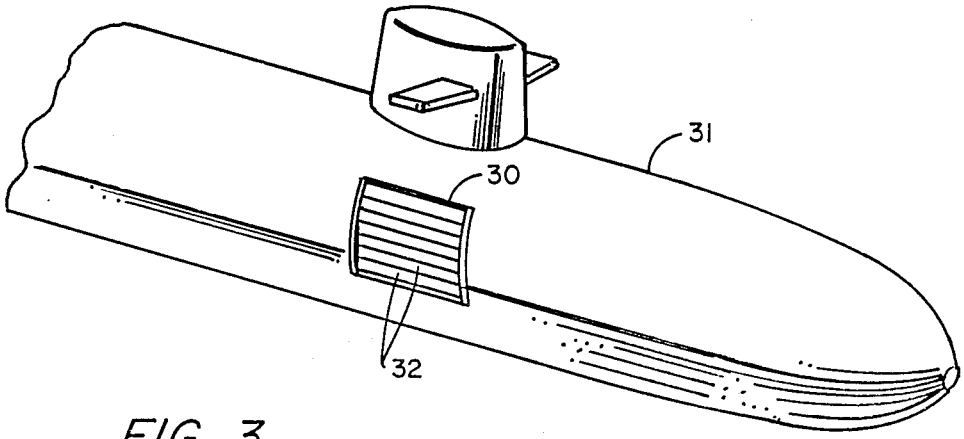
FIG. 3 is a pictorial view of a cylindrical array of this invention attached to a cylindrically-shaped vessel.
Figure 4:
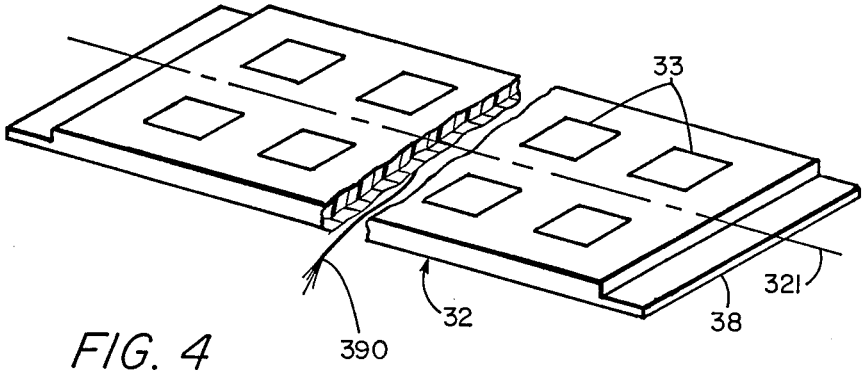
FIG. 4 is an isometric view of the planar transducer segment from which the array of FIG. 1 is assembled.

Referring now to FIG. 3, there is shown a view of the cylindrical array 30 of the preferred embodiment of the invention mounted on a cylindrical portion of a submarine 31. The cylindrical array 30 is comprised of a plurality of flat array segments 32 shown in more detail in subsequent Figures. FIG. 4 shows a perspective view of a rectangular array segment 32 (without an outer decoupler 41) having a central axis of symmetry 321 and showing the polyvinyldifluoride (PVDF) transducer elements 33. Each transducer element 33 comprises a support substrate, typically of glass fiber or a metal such as aluminum, a pair of PVDF voltage producing strain sensitive layers and flexible wiring layers. Details of the manner of interconnection of the PVDF layers with the preamplifier 39 and flexible wiring layers are to be found in U.S. patent application Ser. No. 637,664, assigned to the same assignee as this application and incorporated herein by reference. Each PVDF transducer element is connected to a preamplifier circuit 39 (see FIGS. 5 and 6) whose output is selectively connected to one of the output wires of a flexible wiring layer and whose input connection is selectively connected to the adjacent innermost metallic films on the PVDF layers of a transducer element 33. A ground connection on a flexible wiring layer is selectively connected to the outermost metallic layers of the PVDF layers. Each output wire of a flexible circuit layer connected to a respective one of each transducer element 33 is connected to a terminal of a cable connector 36 of cable 390.

Figure 5:
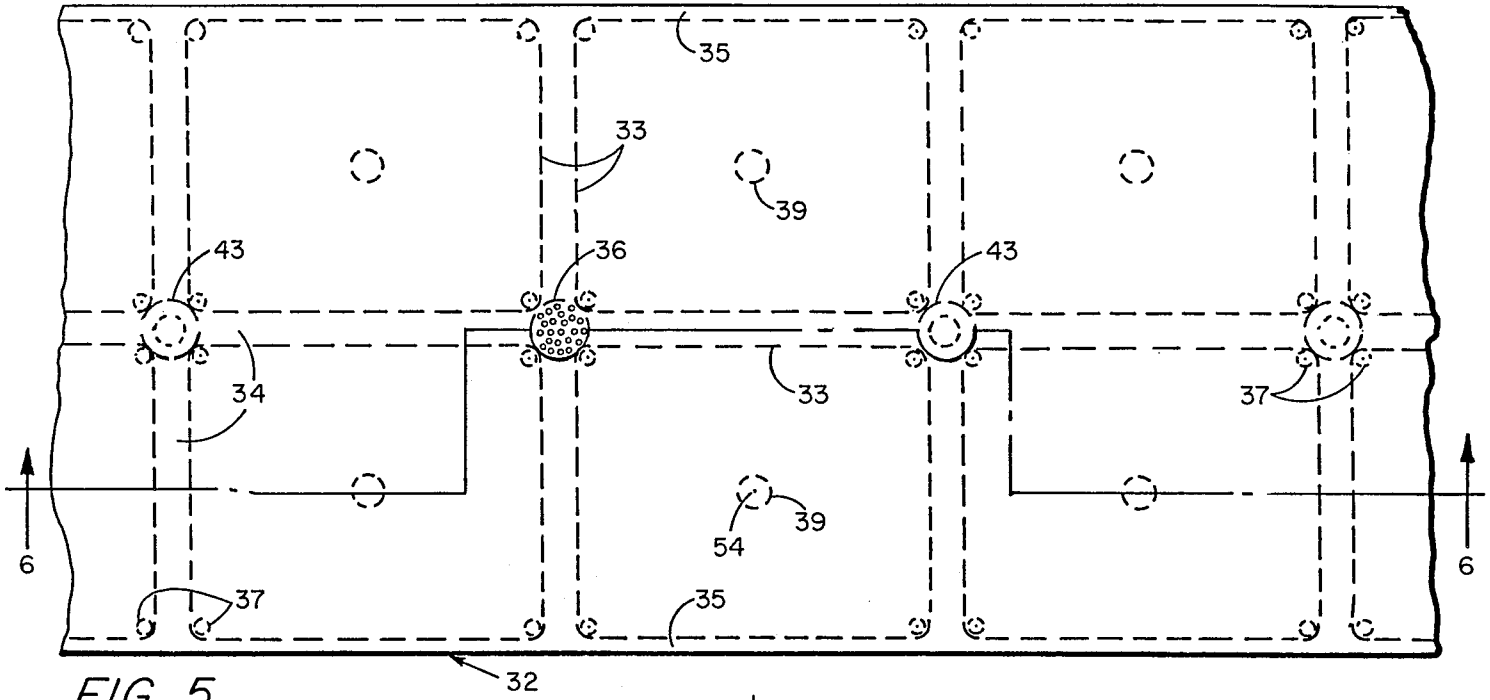
FIG. 5 is a top view of the array segment of FIG. 4.

A top view of a portion of the array segment 32 is shown in FIG. 5. The array segment 32 is seen to comprise two transducer elements 33 in side-by-side relationship with a plurality of elements 33 along the length of the segment 32. The space 34 between the elements 33 is typically one-half inch with the edge spaces 35 being typically one-quarter of an inch. When the array segments 33 are placed in side-by-side relationship, the total space 35' (see FIG. 7*a*) between adjacent elements 33 of adjacent segments 32 is therefore one-half inch. The equal spacing 34, 35' between elements in the array results in uniformity of response to noise signals provided from each element 33 and also provides the symmetry desired for combining element 33 signals for beam forming. Construction of the array segment 32 in a 2×14 element 33 configuration with appropriate spacing between the elements 33 allows the wiring connector 36 to be placed between the four adjacent corners of adjacent elements 33. Two 16-pin connectors 36 spaced along the length of array segment 32 provide sufficient terminals to make electrical connection to the output terminal of each of the preamplifiers 39 of the transducer elements 33 together with the appropriate number of ground wires and power supply wires for the preamps 39 to the cable 390 shown in FIG. 6. The outline of the elements 33 define the size of the active PVDF material. It is understood that the flexible printed wiring layers making connection to the preamps 39 and their respective transducer elements 33 are not shown in FIG. 5, but are shown in U.S. patent application Ser. No. 637,664, which has been previously referenced.

Figure 6:
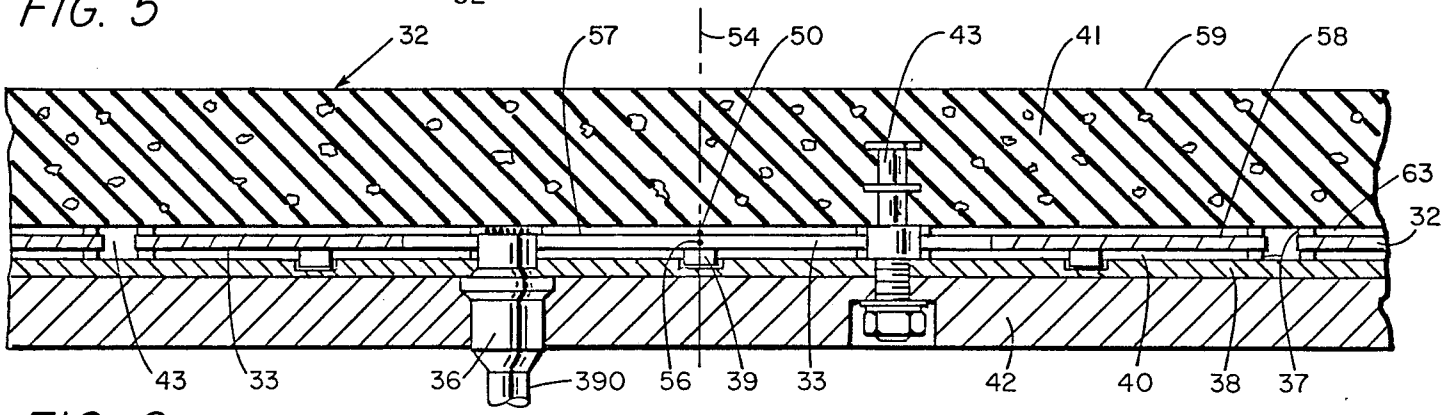
FIG. 6 is a longitudinal cross-sectional view taken along sections lines VI—VI of the transducer segment of FIG. 5.

A sectional view of the array segment 32 taken along section lines 6—6 of FIG. 5 is shown in FIG. 6. It is seen in FIG. 6 that the array segment 32 is supported by vibration isolation stand-offs 37, typically of rubber, at each corner of transducer element 33. The stand-offs 37 on one side of the array segment 32 are attached to a support plate 38, typically one-quarter inch thick steel, which is spaced from the segment 32 by an air gap 40 produced by the stand-offs 37. Support plate 38 is recessed in the vicinity of the preamplifiers 39 to avoid mechanical contact therewith. The other side 58 of the array segment 32 is spaced by air gap 63 from an outer coupler 41 which is typically a two-inch thick layer of rubber containing air voids. The coupler 41 acts to filter out noise signals produced in operation of the array 30 by water passing over the outer surface 59. The support plate 38 is in contact with a signal conditioning plate 42 which, in conjunction with the support plate, acts as a reflector of acoustic energy back to the transducer element 33. The signal conditioning plate is typically a steel plate whose thickness, typically one inch, is dependent on the frequency band of operation in order that the reflected acoustic energy at all frequencies is nearly in phase with the incident acoustic energy at the transducer element 33. Pins 43 secure the outer decoupler 41, the array segment 32 and the support plate 38 to the signal conditioning plate 42 by a nut 44 tightened upon the threaded end 45 of pin 43.

Figure 7:
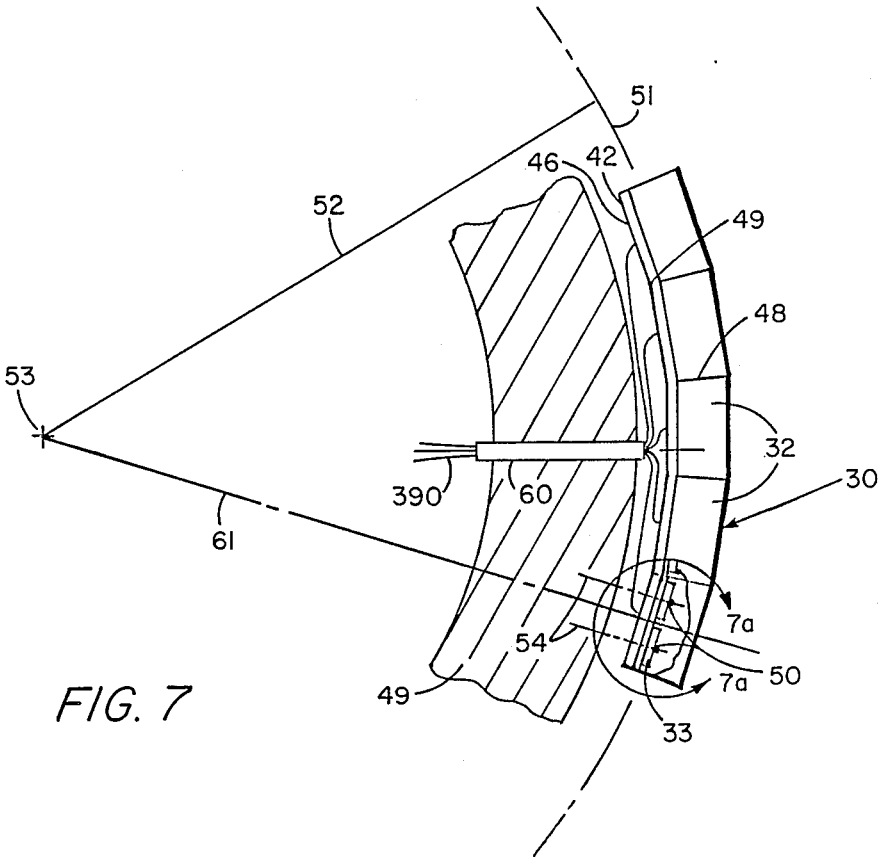
FIG. 7 is an end view of the sonar array of this invention showing a broken-away view within section lines *7a—7a*; and FIG. *7a* is a cross-sectional view taken along section lines *7a–7a* of a portion of the segments used to form the array of FIG. 7.

FIG. 7 shows an end view partially broken-away to show elements 33 of a cylindrical array 30 constructed using the array segments 32 of FIGS. 4–6. The signal conditioning plate 42 comprises a plurality of straight sections 46 having bends 47 at the junctures 48 of each of the array segments 32. The signal conditioning plate 42 is rigidly attached (attachment not shown) to the outer hull 49 of the submarine 31 through which the cables 390 from each array segment 32 penetrate the submarine hull 49 through hull penetrator 60. The cables 390 are connected to sonar processing equipment (not shown) which form beams from the appropriately delayed signals of the transducers 33 of the array segments 32 from which signals coming from particular directions may be detected. Each transducer element 33 has a geometric center 50 which lies in the surface of a cylinder 51 which has a fixed radius 52 from the center axis 53 of the cylindrical array 30. The center axis 53 may coincide with the center axis of the submarine 31. Direction lines 54 which go through the geometric center 50 of each transducer 33 of an array segment 32 are also transverse to the plane of the transducer elements 33. Since the transducer elements 33 of an array segment 32 are all in the same plane, this means that the direction lines 54 are consequently parallel to each other and hence do not converge at the central axis 53. This is contrary to the situation which exists in the prior art where each transducer element of the array is transverse to a radial line extending from the central axis of the cylindrical array through the center of the transducer element. In the cylindrical array of this invention, a radial line 61 passing through the cylindrical axis 53 is, however, transverse to the plane of the array segment 32 and passes through the array segment 32 at a point 320 (shown in FIG. 7*a*) midway between the centers 50 of the transducer elements 33 of each segment 32. The flat array segment 32 prevents each hydrophone transducer element 33 from being normal to the array cylindrical center line 53. However, acoustic symmetry of the array is maintained because each hydrophone transducer element 33 is equidistant from each other and to the array cylindrical center line 53. Where the flat array segment 32 consists of exactly two rows, the geometric centers 50 of the array elements 33 of an array segment 32 are constrained to follow a curved surface 51 exactly.

Figure 7A:
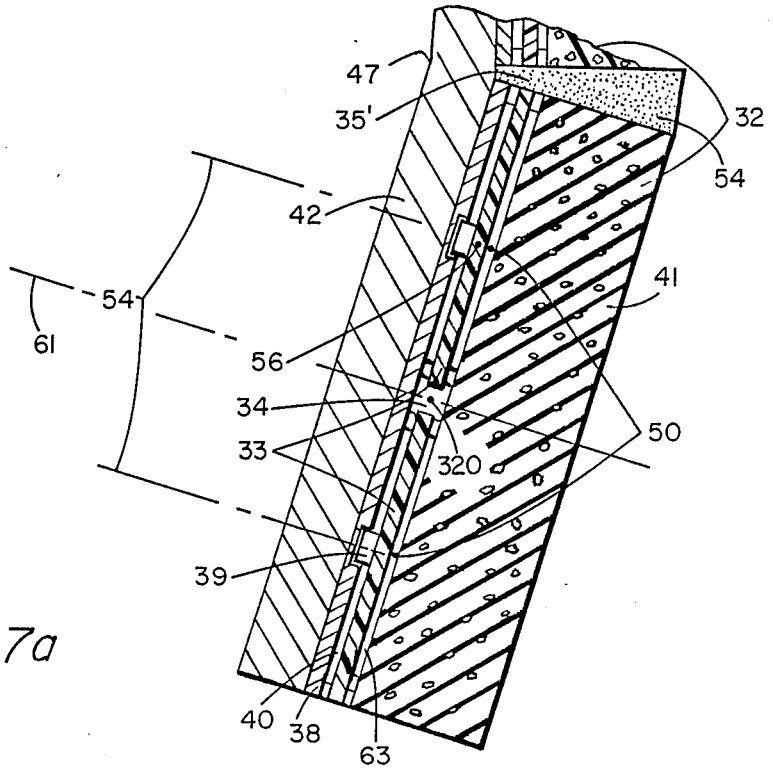

The acoustic center 56, shown in FIG. 7*a*, of an element 33 is defined as the origin from which the acoustic field produced by the element may be considered to have emanated. The acoustic center of an element which is symmetrical with respect to an axis will have its acoustic center located on the axis. Thus, an element 33 will have its acoustic center 56 lie along the direction line 54 about which element 33 is symmetrical. In general, the acoustic center 56 will not coincide with the geometric center 50 of the face 57 even though each center 50, 56 will lie on the direction line 54. Because the geometric center 50 of the face 57 of each element 33 is a convenient reference point, the centers 50 are caused to lie on the cylindrical surface 51. Since all the elements 33 are the same, the displacement of the acoustic center of each from the geometric center is also the same. Thus, the acoustic centers 56 also lie on a cylindrical surface which is concentric with the cylindrical surface 51. Therefore, the invention may be described in terms of either the acoustic centers or the geometric centers lying on the surface of a cylinder.

In electrical performance, the only difference between the flat segment of this invention and the curved segment of the prior art is that the elements in the flat segment are tilted by a small amount, but with an average tilt of 0° for pairs of elements. Since elements 33 usually must be smaller than one wavelength, the tilt tends to be selfcompensating in any system configuration, including where localization in range is required.

FIG. 7*a* shows in detail that portion of FIG. 7 delineated by section lines 7*a*—7*a*. The bend 47 of the signal conditioning plate 42 is seen to occur at the region 48 where segments 32 are contiguous. The small space between the contiguous segments 32 is filled with a rubber or elastomeric material 54 in order to provide a smooth exterior surface for the cylindrical array. The acoustic properties of the material 54 should be similar to those of the decoupler material 41 in order to prevent acoustic reflections by the material 54.

Having described a preferred embodiment of the invention, it will be apparent to one of skill in the art that other embodiments incorporating its concept may be used. It is felt, therefore, that this invention should not be limited to the disclosed embodiment but rather should be limited only by the spirit and scope of the appended claims.

What is claimed is:

1. A cylindrical array of transducers comprising:
a plurality of planar array segments lying in a corresponding plurality of planes;
each segment comprising a plurality of solely planar pairs of transducer elements;
each of said elements having an acoustic center;
the acoustic centers of each pair being on a different parallel transverse axis;
means for supporting each of said plurality of segments to cause each said acoustic center of a planar pair of each segment to lie on a circle transverse to a longitudinal axis to form an array.

2. The array of transducers of claim 1 wherein:
each segment comprises a plurality of said pairs of transducer elements extending in the longitudinal axis direction;
said transducers of each segment have their acoustic centers lying in a plane parallel to said longitudinal axis;
each pair of transducers of a segment are longitudinally displaced from and in longitudinal alignment with the other pairs of transducer elements of said segment so that each acoustic center of said transducers of each segment lies on the surface of a cylinder.

3. The cylindrical array of transducers of claim 1 wherein:
adjacent transducers of a pair on each segment are spaced by equal amounts; and
the spacing between transducers of a first pair is equal to the spacing between adjacent transducers of a said first pair and of a second pair in an adjacent array segment.

4. The cylindrical array of transducers of claim 2 wherein:
the transducers of an array segment are spaced from each other by equal amounts;
the spacing between adjacent transducers of one array segment and an adjacent array segment are equal to the spacing between transducers of an array segment.

5. A cylindrical array of transducers comprising:
a plurality of planar rectangular array segments, each segment having a central axis of symmetry;
each segment comprising a plurality of transducer elements in only two columns of elements;
said columns extending parallel to said axis of symmetry;
each column of elements of a segment having geometric centers equally spaced from said central axis;
a cylindrically shaped supporting plate;
said plate having flat circumferential regions extending longitudinally at an angle with respect to its adjacent region; and
each of said planar rectangular array segments being attached to a respective one of said flat regions of said plate to form a cylindrical array of transducer elements whose said geometric centers lie on a cylinder.

6. A cylindrical array of transducers comprising:
a plurality of planar rectangular array segments;
each segment comprising a plurality of transducer elements in columns of only two side-by-side elements;
each of said elements of a segment having a geometric center; and
means supporting each of said plurality of segments at an angle with respect to its adjacent segment to have the geometric center of each element of each of said segments lie on a cylindrical surface to form a cylindrical array of transducer elements.

7. The cylindrical array of transducers of claim 6 wherein said supporting means comprises:
a cylindrically-shaped supporting plate;
said plate having flat circumferential regions extending longitudinally; and
each of said planar rectangular array segments being attached to a respective one of said flat regions of said plate to form said cylindrical array of transducer elements.

8. The cylindrical array of transducers of claim 7 wherein said supporting means comprises a conditioning plate.

9. An array of transducers comprising:
said array having an axis of symmetry;
a plurality of support members which are planar in at least one dimension;
a plurality of only pairs of transducers mounted on each of said support members;
each transducer having an acoustic center;
a corresponding pair of said plurality of transducers on each of said plurality of support members being circumferentially spaced and having their acoustic centers on the first circle centered on and transverse to said axis of symmetry;

a different two of said plurality of transducers on each of said plurality of support members having their acoustic centers on a second circle centered on and transverse to said axis of symmetry; and said first and second circles being axially spaced from one another.

10. The array of claim 9 wherein:

said first and second circles are of the same diameter.

11. The array of claim 9 wherein:

said axially spaced first and second circle are such that the axial separation of said acoustic centers is equal to the circumferential spacing of said acoustic centers.

* * * * *